US005823343A

United States Patent [19]

Heffernan

[11] Patent Number: 5,823,343

[45] Date of Patent: Oct. 20, 1998

[54] PACKAGING APPARATUS

[76] Inventor: Darryl James Heffernan, 18 Sierra Close, Leeming, Western, Australia, 6155

[21] Appl. No.: 839,398

[22] Filed: Apr. 11, 1997

Related U.S. Application Data

[63] Continuation of Ser. No. 513,128, Aug. 9, 1995, abandoned.

[51] Int. Cl.[6] ..... B65D 85/48

[52] U.S. Cl. ..... 206/451; 206/597; 206/804; 53/592

[58] Field of Search ..... 206/449, 451, 206/597, 804; 217/66; 53/390, 592

[56] References Cited

U.S. PATENT DOCUMENTS

| | | | |
|---|---|---|---|
| 3,038,403 | 6/1962 | Orelind | 100/34 |
| 3,491,681 | 1/1970 | Saro, Jr. et al. | 100/34 |
| 3,917,066 | 11/1975 | Cloyd | 206/597 |
| 4,167,903 | 9/1979 | Lasher | 100/34 |
| 4,681,032 | 7/1987 | McDermott | 53/592 |
| 4,756,138 | 7/1988 | Karpisek | 206/597 |
| 4,934,262 | 6/1990 | Turi et al. | 100/34 |
| 4,964,518 | 10/1990 | Wilson | 100/34 |
| 5,007,550 | 4/1991 | Avot | 220/8 |
| 5,022,316 | 6/1991 | Hellwig | 200/34 |
| 5,072,576 | 12/1991 | Evans | 53/592 |
| 5,114,020 | 5/1992 | Martin | 211/50 |
| 5,129,526 | 7/1992 | Craff, Jr. et al. | 206/449 |
| 5,150,646 | 9/1992 | Lonczak | 106/34 |
| 5,282,545 | 2/1994 | White | 100/34 |
| 5,312,035 | 5/1994 | Nold et al. | 229/104 |
| 5,533,318 | 7/1996 | Murat | 53/592 |

FOREIGN PATENT DOCUMENTS

| | | |
|---|---|---|
| 5594486 | 10/1986 | Australia . |
| 57744 | 9/1981 | European Pat. Off. . |
| 350473 | 7/1989 | European Pat. Off. . |
| 4108235 | 9/1992 | Germany . |

*Primary Examiner*—David T. Fidei
*Attorney, Agent, or Firm*—Gipple & Hale; John S. Hale

[57] ABSTRACT

A method of packaging generally flat material utilizing a packaging frame having a substantially planar rectangular base defined by four sides, a substantially rectangular upright side frame at each side of the base, the base being fixed relative to the side frames, the base being formed with a pair of intersecting recessed channels which extend transversely across the base between respective pairs of opposed sides and the channels being from about 10 to about 25 mm in width, and the channels having respective end openings in the base which end openings are externally accessible even when the packaging frame contains material, wherein the packaging frame is loaded with generally flat material, and then fastening straps are manually passed through the channels via end openings thereof until an end of each strap extends beyond the opposite end opening in the channel, arranging the fastening straps around the generally flat material, engaging free ends of the fastening straps and then tensioning the fastening straps to form a bundle of generally flat material, and removing the bundle from the packaging frame.

2 Claims, 6 Drawing Sheets

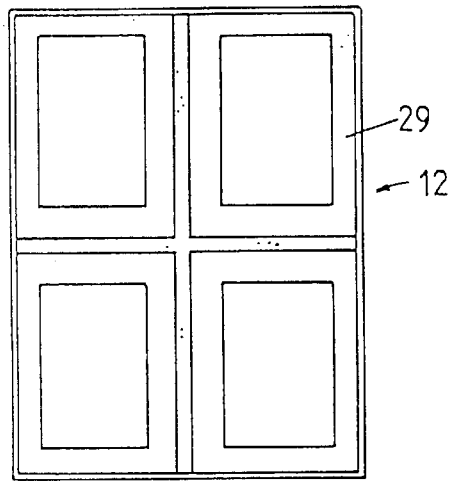
FIG. 2
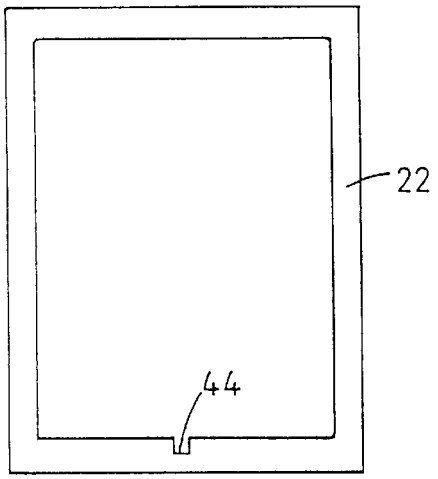
FIG. 3
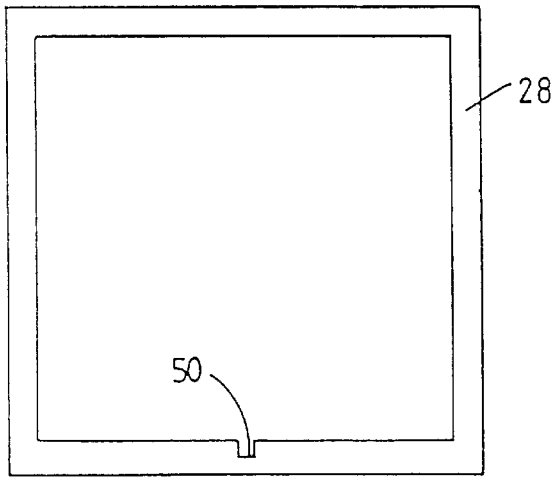
FIG. 4
FIG.4

PACKAGING APPARATUS

This application is a Continuation of Ser. No. 08/513,128, filed Aug. 9, 1995, now abandoned.

BACKGROUND OF THE INVENTION

1. Field of the Invention

The present invention relates to a method of and apparatus for packaging which facilitates the storage and packaging of generally flat materials such as newspapers, magazines, cartons, picture frames and the like.

2. Brief Description of the Background

With increased community awareness of the need to recycle material, more and more households are adopting the practice of storing newspapers, magazines and the like for delivery to recyclers. There is therefore a need to provide a simple means to store and package the material for recycling that is both convenient to the householder and to the recycler.

Further, emphasis on the recycling of paper products is also relevant to commercial retail outlets and industry which have goods delivered to them in the form of cartons. Particular examples of such installations comprise supermarkets and liquor stores and in both instances the disposal of the cartons can present a significant problem. In order to create a situation where the cartons can be recycled it is desirable to provide a convenient storage and packaging means to facilitate recycling.

Many devices for facilitating the storage and packaging of materials such as newspapers have been designed and developed in the past. Prior art as shown in U.S. Pat. No. 5,072,576 discloses a four walled, open top newspaper bundler with a hollow pedestal base and bottom wall section. Integral with the container are a pair of compartments below the container bottom wall each for holding a spool of cord for tying up the bundle of newspapers. U.S. Pat. No. 5,129,526 discloses a newspaper container and bundler which has three walls, an open front and a bottom surface. Newspapers are stacked on pedestals integral with the bottom surface. The configuration of the bottom surface facilitates the location of balls of cord or twine for tying up the bundle of newspaper.

U.S. Pat. No. 4,934,262 discloses a four walled container with a bottom surface, having a support tray located therein. Spools of twine are located between the bottom surface and the support tray with the twine being arranged in grooves on the support plate. There are a number of disadvantages with the known art. Primarily, all of the above devices utilise automated spools and they must have the binding means such as cord or twine arranged in the device prior to filling the respective devices with newspapers and the like. If this is not done prior to filling the device with material, the material cannot be bundled and as a consequence the material must be removed, the binding means arranged and then the material restacked. This is both time consuming and inconvenient and defeats the purpose of the device.

A further disadvantage with some devices of the prior art is that they do not provide a solid base and therefore lack stability and strength and do not facilitate compacting of the stored material.

The present invention seeks to provide a means of storing and packaging to facilitate recycling of papers, cartons, magazines and the like and to address some of the above-mentioned problems.

SUMMARY OF THE INVENTION

In accordance with a first aspect of the present invention there is provided a method of packaging generally flat material utilizing a packaging frame, having a substantially planar rectangular base defined by four sides, a substantially rectangular upright side frame at each side of the base, the base being fixed relative to the side frames, the base being formed with a pair of intersecting recessed channels which extend transversely across the base between respective pairs of opposed sides and the channels being from about 10 to 25 mm in width, and the channels having respective end openings in the base which end openings are externally accessible even when the packaging frame contains material, wherein the packaging frame is loaded with generally flat material, and then fastening straps are manually passed through the channels via end openings thereof until an end of each strap extends beyond the opposite end opening in the channel, arranging the fastening straps around the generally flat material, engaging free ends of the fastening straps and then tensioning the fastening straps to form a bundle of generally flat material, and removing the bundle from the packaging frame.

In accordance with a second aspect of the present invention there is provided a packaging frame having a substantially planar rectangular base defined by four sides, a substantially rectangular upright side frame at each side of the base, the base being fixed relative to the side frames, the base being formed with a pair of intersecting recessed channels which extend transversely across the base between respective pairs of opposed sides and the channels being from about 10 to 25 mm in width, and the channels having respective end openings in the base which end openings are externally accessible even when the packaging frame contains material.

BRIEF DESCRIPTION OF THE DRAWINGS

The present invention will now be described, by way of example, with reference to the drawings, in which:

FIG. 2 is an upper plan view of the base of the packaging frame;

FIG. 3 is a side view of a packaging frame according to the present invention;

FIG. 4 is a further side view of a packaging frame according to the present invention;

DETAILED DESCRIPTION OF THE DRAWINGS

Figure 1:
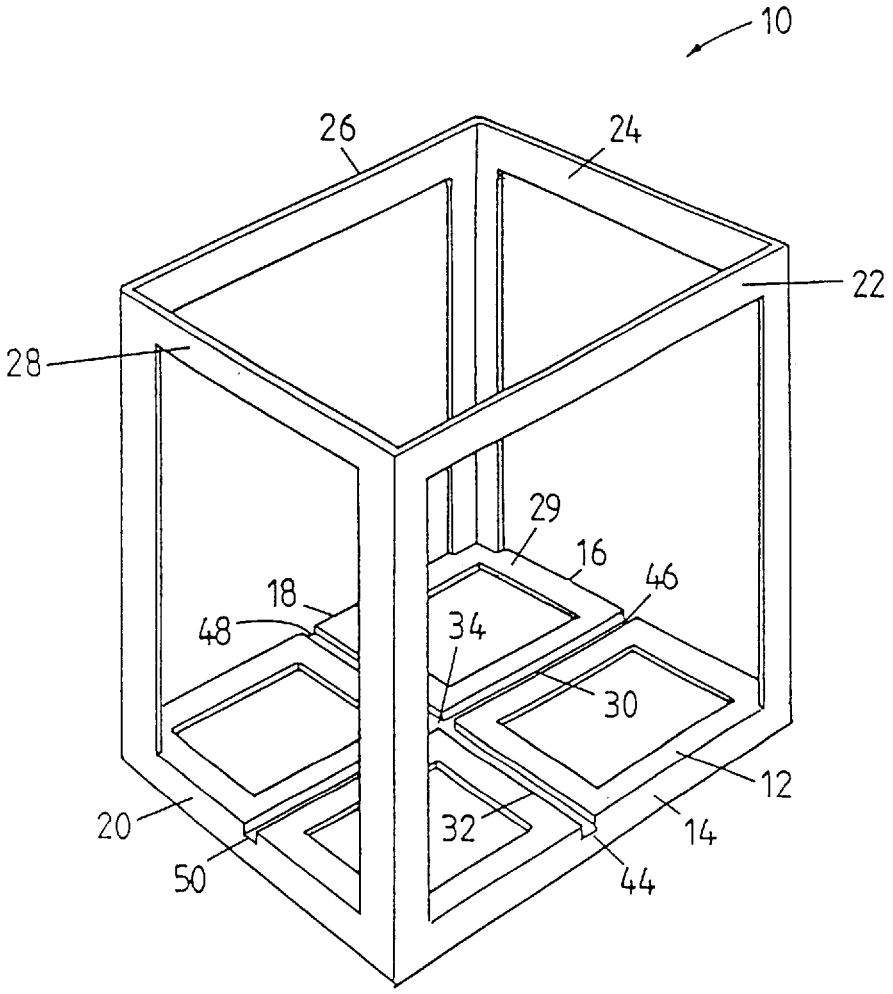
FIG. 1 is a perspective view of a packaging frame according to the present invention.

In the drawings there is shown a packaging frame 10 which can be used for the storage and stacking of generally flat material such as sheet material. In particular the packaging frame is intended for use with newspapers and the like whereby upon the packaging frame 10 being filled a fastening means can be arranged and the contents can be fastened together and readily removed for delivery to a recycling collection point or to a recycler. The packaging frame 10 as shown in FIG. 1 has a substantially rectangular base 12 defined by sides 14,16,18 and 20. Extending upwardly from the sides 14,16,18 and 20 of the base 12 are respective side frames 22,24,26 and 28. The base 12 is fixed in position relative to the side frames 22,24,26 and 28. As can be seen in FIG. 1, the packaging frame 10 has an open top and open sides. In a preferred embodiment the side frames 22,24,26 and 28 are tapered at a slight draft angle such that the top of the packaging frame 10 is wider than the base 12.

The base 12 is provided with an upwardly facing surface 29 which is formed with a pair of intersecting linear channels 30 and 32. The channels 30 and 32 intersect substantially at right angles as shown in FIG. 2. The channels 30 and 32 are recessed in the base 12. The channels 30 and 32 extend transversely across the base 12 between pairs of opposed sides of the packaging frame 10. The channel 30 is arranged between sides 16 and 20. The channel 32 is arranged between sides 14 and 18. The channels 30 and 32 intersect each other substantially as the centre 34 of the base 12.

The channels 30 and 32 are from about 10 to about 25 mm in width, preferably from about 12 to about 15 mm in width. The channels 30 and 32 have smooth and uninterrupted walls and floors and are arranged to receive a respective fastening strap 36 and 38 of corresponding width. Preferably, the fastening straps 36 and 38 take the form of strapping of plastics material which is from about 11 to about 14 mm in width having a locking member at one end 40 and a leading end 42. Further, the length of the fastening strap 36 and 38 may be formed with a series of serrations which interlockingly engage with the locking member in known manner.

It is envisaged that the channels 30 and 32 will provide from about 1 to about 2 mm tolerance in respect to the width of the fastening straps 36 and 38.

This arrangement of the channels 30 and 32 provides end openings 44,46,48 and 50 which are accessible from outside the packaging frame 10. The end openings 44,46,48 and 50 are externally accessible even when the packaging frame 10 is full of material. Referring to the figures, the manner of use and operation of the packaging frame 10 of the present invention will now be described.

Figure 5:
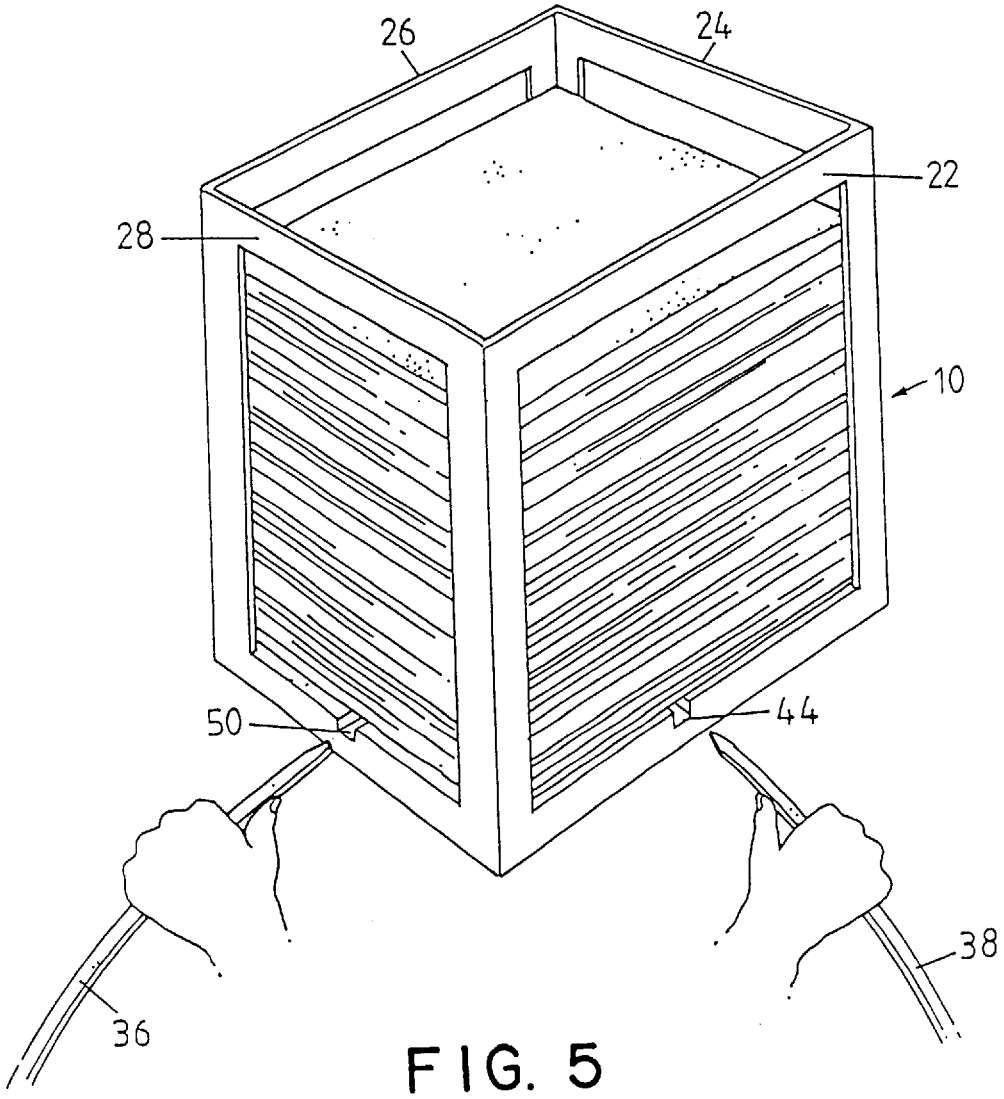
FIG. 5 is a perspective view of the packaging frame of FIG. 1 filled with newspapers, cartons, magazines or the like showing the application of a fastening means.
Figure 6:
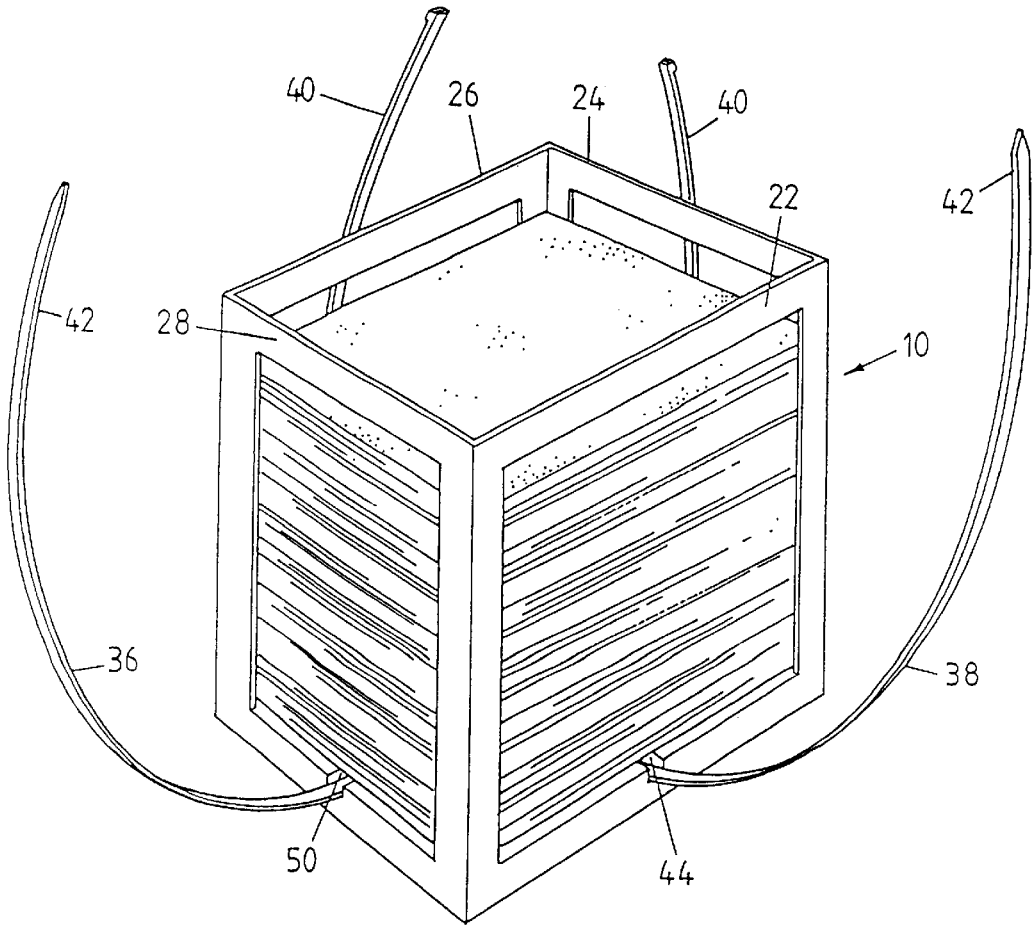
FIG. 6 is a perspective view of the container of FIG. 5 showing the fastening means in place.
Figure 7:
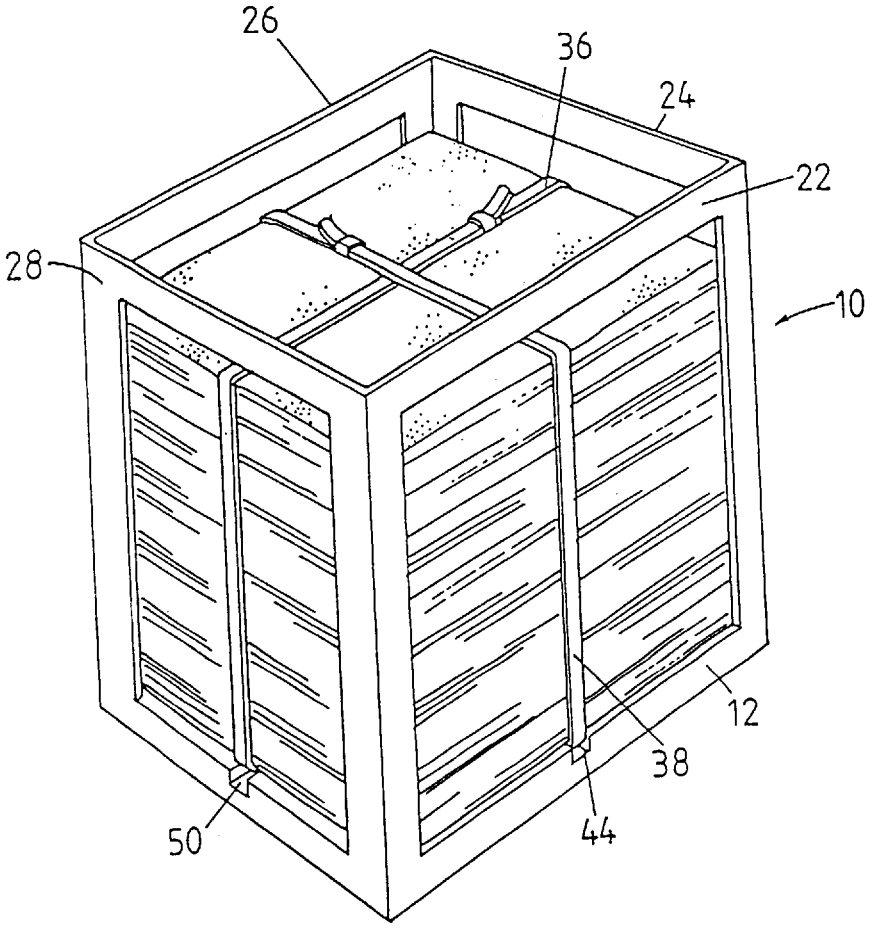
FIG. 7 is a perspective view of the container of FIG. 5 showing the fastening means applied over the contents.
Figure 8:
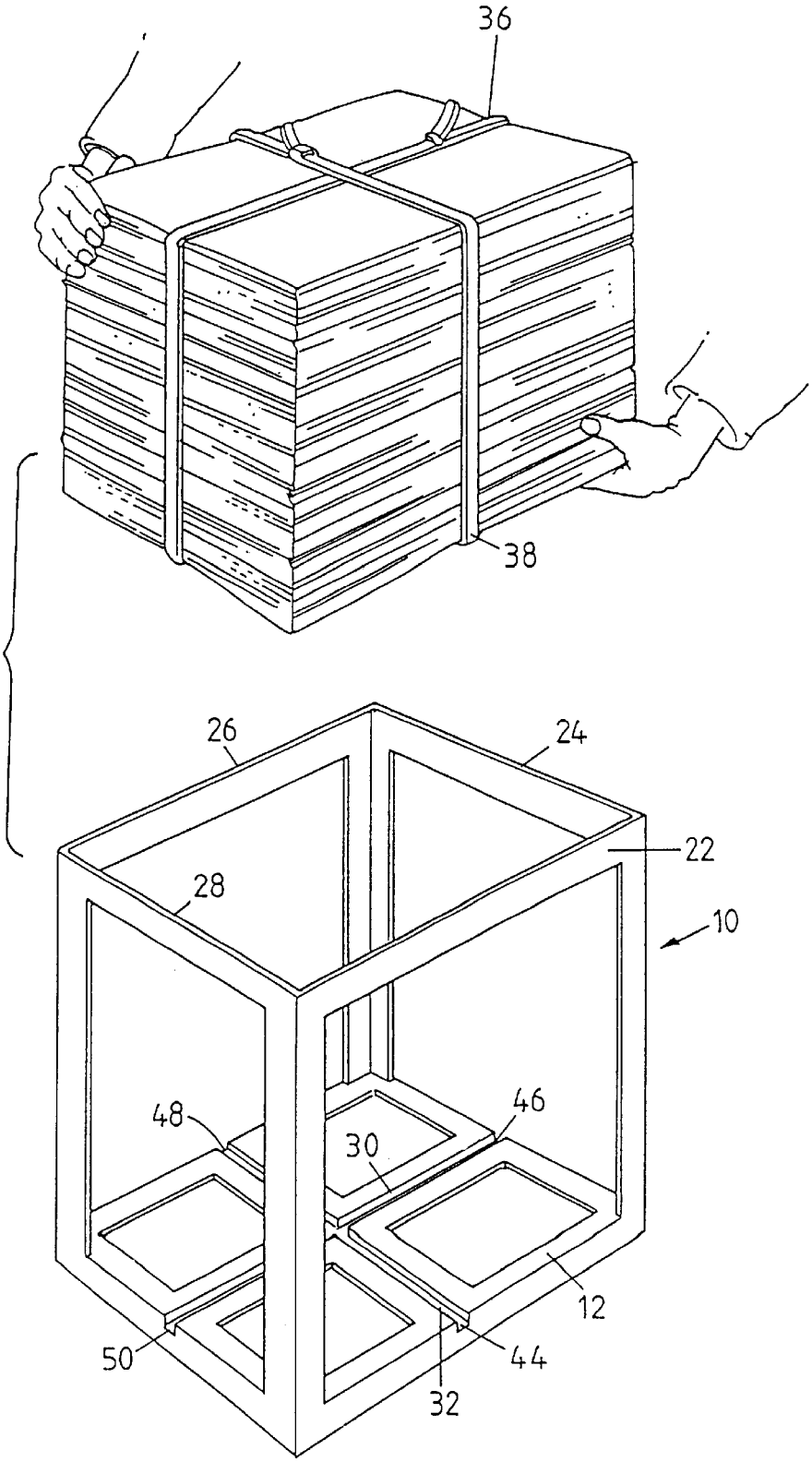
FIG. 8 is a perspective view of the packaging frame of the present invention showing the packaged contents being removed from the packaging frame.

In use, newspapers, magazines or the like are deposited into the packaging frame 10. When the packaging frame 10 is full as shown at FIG. 5, the fastening strap 36 may be inserted into the channel 30 through the opening 46 or 50 and the fastening strap 38 may be inserted into the channel 32 through the opening 44 or 48. The fastening straps 36 and 38 are guided manually through the respective channels 30 and 32. The fastening strap 36 is guided through the channel 30 until the end 42 of the fastening strap 36 extends beyond the opposite end opening 50 or 46. The fastening strap 38 is guided through the channel 32 until the end 42 of the strap 38 extends beyond the opposite end opening 48 or 44. In this arrangement, the fastening straps 36 and 38 underlie the contents of the packaging frame 10 (as shown in FIG. 6). The fastening straps 36 and 38 are then arranged around the contents with the fastening straps 36 and 38 drawn upwardly and inserted through the respective side frames 22,24,26 and 28 where the end 42 is engaged in a locking member and the fastenings straps 36 and 38 are tensioned around the contents as shown a FIG. 7. Once both of the fastening straps 36 and 38 have been fixed, the contents of the packaging frame 10 can be removed manually as a unit for delivery to a recycling station or collection point. On the packaged goods being received at the recycling station, it is only a matter of the operator cutting the fastening straps and depositing the packaged papers, cartons, magazines and the like into the reprocessing station.

As will be appreciated, the packaging frame 10 may be formed in a range of sizes to accommodate the storage and packaging of materials of different size and configuration. Larger packaging frames 10 designed in accordance with the present invention can be used to accommodate cardboard boxes and the like. The advantage of the present invention being that the packaging frame 10 provides a means to store and pack cardboard boxes and allows this material to be compacted since the base 12 provides solid support. Modifications and variations such as would be apparent to a skilled addressee are deemed within the scope of the present invention.

I claim:

1. A packaging frame for packaging generally flat material, said packaging frame including a substantially rectangular base defined by four sides, each pair of adjacent sides intersecting at a respective corner, a respective side frame extending upwardly from each side, each side frame including a pair of spaced upright flat webs each having opposed major surfaces and extending upwardly from the respective side with the major surfaces parallel to the respective side, each web having inner and outer sides and an upper end, each web being disposed adjacent a corner of the base so that the outer side thereof is orthogonally contiguous with the outer side of a web of a side frame of an adjacent side, a respective laterally extending flat cross member interconnecting the upper ends of the webs of each side frame, each flat cross member having opposed major surfaces which are disposed parallel to the major surfaces of the upright flat webs, the arrangement being such that the packaging frame has an open top and open sides, the base having an upwardly facing surface and the base being fixed relative to the side frames, a pair of intersecting recessed channels extending transversely across the base between respective pairs of opposed sides and being recessed into the upwardly facing surface of the base, the channels each having opposite end openings in the base which are externally accessible even when the packaging frame contains material, and the channels being from 10 to 25 mm in width and intersecting one another substantially at right angles.

2. A packaging frame according to claim 1, wherein the channels provided in the base are from about 12 to about 15 mm in width.

* * * * *